US005743501A

United States Patent [19]

Rapp

[11] Patent Number: 5,743,501

[45] Date of Patent: Apr. 28, 1998

[54] MOUNTING SYSTEMS FOR UNDER MOUNT SINKS

[75] Inventor: William M. Rapp, Arlington Heights, Ill.

[73] Assignee: Vance Industries, Inc., Chicago, Ill.

[21] Appl. No.: 641,172

[22] Filed: Apr. 30, 1996

[51] Int. Cl.[6] ..... F16M 11/00

[52] U.S. Cl. ..... 248/201; 248/200.1; 4/633

[58] Field of Search ..... 248/201, 200.1, 248/212, 213.2, 220.21; 4/631–636; D8/349, 354, 373, 388

[56] References Cited

U.S. PATENT DOCUMENTS 4,432,106 2/1984 Smith ..... 4/633
5,386,959 2/1995 Laughlin et al. ..... 248/200.1
5,505,419 4/1996 Gabrius ..... 248/200.1

*Primary Examiner*—Leslie A. Braun
*Assistant Examiner*—Willie Berry, Jr.
*Attorney, Agent, or Firm*—McCaleb, Lucas & Brugman

[57] ABSTRACT

An improved mounting system for clamping sinks, vanity basins, drop-in stove tops and like articles to the underside of a counter or cabinet top incorporating a pair of elongated unitary, rigid mounting rails configured to carry threaded leveling bolts and nuts at adjustably spaced intervals along its length for underengaging and clamping the rim flange at the upper end of the sink or the like to the underside of a countertop. Hanger brackets attachable to the upper margins of countertop supporting cabinet structural frame rails or walls provide vertically adjustable connection with opposite ends of the mounting rails mounted thereon to accommodate sinks, basins or stove tops having rim flanges of varying thickness and dimensions.

5 Claims, 2 Drawing Sheets

MOUNTING SYSTEMS FOR UNDER MOUNT SINKS

FIELD OF THE INVENTION

This invention is related generally to an improved system for clamping and mounting sinks, basins, drop-in stove tops and similar articles to the under side of cabinet countertops whereby the sink or basin may be adjustably leveled and secured in operating position opposite an overlying access opening in the countertop.

BACKGROUND OF THE INVENTION

Undermount sinks, basins and the like have heretofore been mounted to the underside of cabinet countertops opposite an overlying access opening in the countertop by means of a series of spaced, individual adjustment brackets and leveling bolts anchored directly to the underside of the countertop giving rise to possible damage of the countertop by the installer. The brackets are individually located and adjusted to engage the underside of the sink's rim flange extending about the open end of the sink bowl whereby to force the flange tightly against the bottom side of the countertop. This system requires careful and time consuming adjustment and alignment of the many individual adjustment brackets and frequently requires shims and the like to achieve a level sink position, particularly if the cabinet itself or the countertop is not horizontal.

More recently a variation of the aforenoted individual bracket mounting system has been presented employing a pair of lengthwise adjustable, two-piece, stamped metal brackets having upturned attachment arms at the outer ends of linear bracket sections for securing the same to and between spaced sides or frame rails of the cabinet. The two bracket sections are bolted together at overlapping end portions thereof and within slotted openings to accommodate limited lengthwise adjustment of the assembled brackets. Each bracket carries several leveling bolts threaded through openings at fixed positions therealong for underengaging and clamping the sink flange against the underside of the countertop. While this system appears to be an improvement over the individual bracket system noted above, in that the leveling bolts thereof are positioned and held by the two-piece elongated bracket, the limited fixed spacing and location of the leveling bolts frequently fails to accommodate multiple sink sizes and provide the necessary flexibility to meet a variety of other installation requirements. Additionally, the need to fix the two sections of each adjustable bracket together results in a weakened support structure especially when the brackets are extended to their full length to meet cabinet dimensions. This seriously detracts from the clamping action motion of the leveling bolts. While this support system is sufficient to support lightweight sinks, it is not satisfactory under the load of heavier articles, such as cast iron, ceramic or composite sinks and heavy drop-in stove tops. Currently, these heavier articles are usually under supported directly on heavy wooden frames built into the cabinet at installation of the sink or stove top.

This invention is directed to overcoming the aforenoted problems and deficiencies of prior support assemblies utilized to undermount sinks, basins and like items beneath a cabinet top or the like.

BRIEF SUMMARY OF THE PRESENT INVENTION

Briefly, the mounting system of this invention comprises a pair of rigid, extruded metal rail members having a cross sectional configuration designed to slidably accommodate leveling bolts and nuts. Upper walls of the rail members are distinguished by plural-spaced slotted openings through which the leveling bolts may be extended as selected. A pair of mounting brackets cooperate with the opposite ends of each rail to fix the rail at selected elevations beneath the cabinet countertop. Each bracket has a linear leg adapted to be fastened securely to the interior of a cabinet wall or horizontal support rail. A planar arm preferably extends across the upper end of the bracket leg to overhang the top of a cabinet wall or support rail. A plurality of spaced connector fingers project from one side of the bracket leg for insertably or abuttingly engaging and interconnecting with the ends of an associated support rail. Various dimensional distances between cabinet walls or support rails are accommodated by cutting the support rails to length as needed.

It is an important object of this invention to provide a new and simplified support assembly for mounting stainless steel, cast iron, porcelain steel sinks and vanity basins, drop-in stove tops, and like articles beneath an opening in a countertop without connecting fasteners to the countertop.

Still another object of this invention is to provide an improved positive mounting system for undermounting cast iron, ceramic or composite material sinks, basins and like heavy articles to the underside of countertops.

A further object of this invention is to provide an improved mounting system as set out in the preceding object which provides a positive and rigid mount capable of readily leveling and clamping undermount sinks, basins or the like in operating position beneath the underside of a countertop.

A still further important object of this invention is to provide an improved mounting system for installing kitchen sinks, vanity basins, drop-in stove cook tops and equivalent articles beneath an access opening in a countertop which is marked by improved economies of production, convenience of installation and dependability in use.

Having described this invention, the above and further objects, features and advantages thereof will appear to those of skill in the art from the following detailed description of a preferred embodiment thereof illustrated in the accompanying drawings and representing the best mode presently contemplated for enabling those of skill in the art to practice this invention.

In The Drawings

DESCRIPTION OF THE PREFERRED EMBODIMENT

Figure 1:
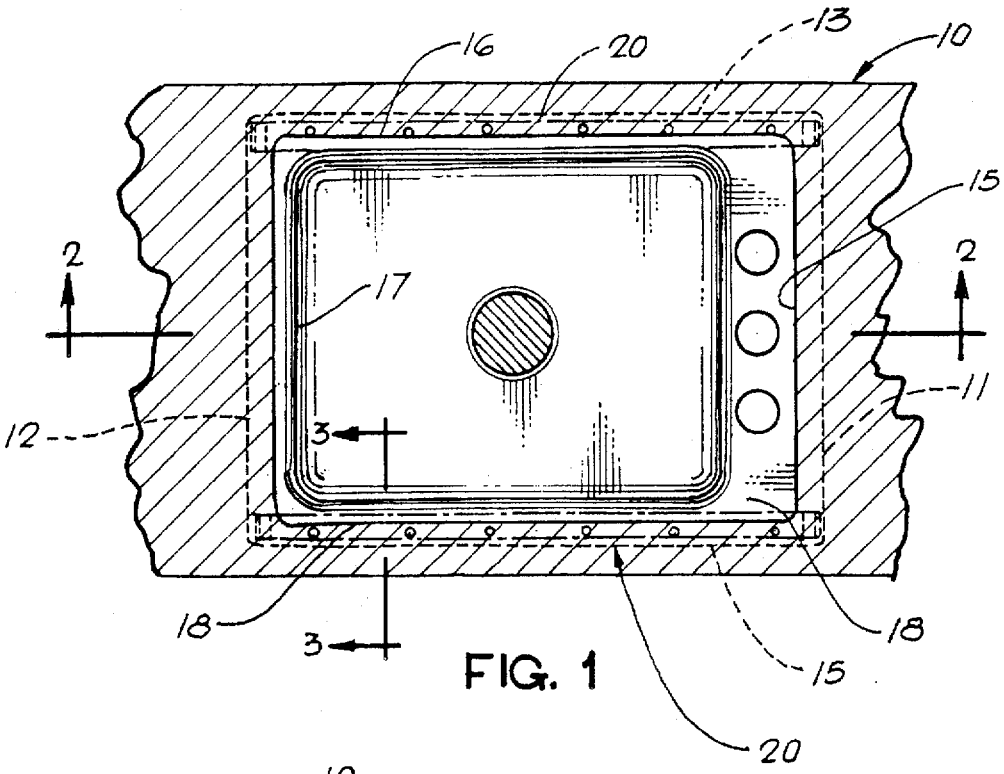
FIG. 1 is a partial top plan view of a countertop and undermounted sink assembly in accordance with this invention.
Figure 2:
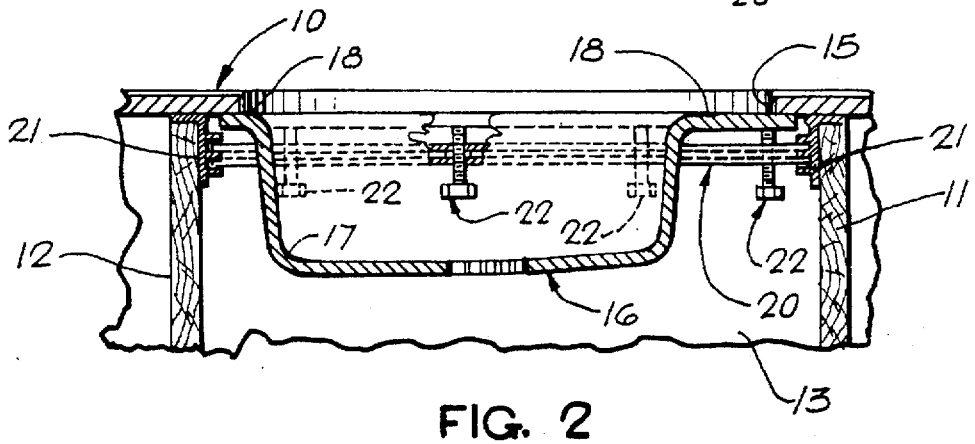
FIG. 2 is a longitudinal cross sectional view of the assembly shown in FIG. 1, taken substantially along vantage line 2—2 of that figure and looking in the direction of the arrows thereon.
Figure 3:
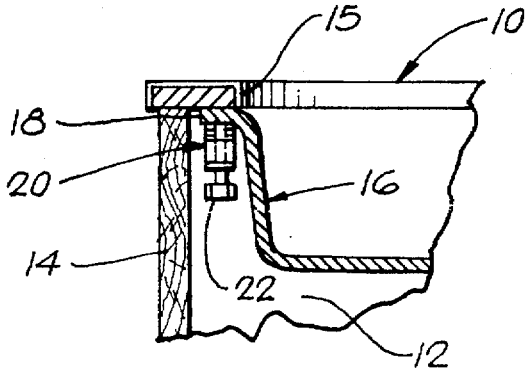
FIG. 3 is a partial cross-sectional view taken along vantage line 3—3 of FIG. 1 and looking in the direction of the arrows thereon.

With initial reference to FIGS. 1–3 of the drawings, it will be recognized that planar countertop indicated generally at 10, is mounted horizontally over an undersupporting cabinet structure having parallel spaced walls 11, 12, 13 and 14. Countertop 10 is distinguished by an enlarged generally rectangular shaped access opening 15 beneath which is undermount sink 16 having a depressed or central bowl portion or area 17 formed integrally with a laterally extending rim flange 18 about the upper end periphery of bowl 17, all in conventional fashion.

The improved mounting assembly according to this invention comprises a pair of elongated linear, rigid rails 20, 20 extending along opposite sides of the sink 16, with the ends of such rails being supported by mounting brackets 21, 21 affixed to a suitable support such as the opposing walls 11, 12 of the cabinet. A plurality of vertically adjustable leveling devices 22, 22 for leveling sink 16 and clamping it to counter 10 are mounted at desired positions along the length of each of the mounting rails 20, 20 as will be described in great particular presently.

While the generalities of the current invention are apparent from the foregoing description, specific features of the improved mounting system of this invention will be better understood from FIGS. 4–9 of the drawings and the detail description which follows.

Figure 5:
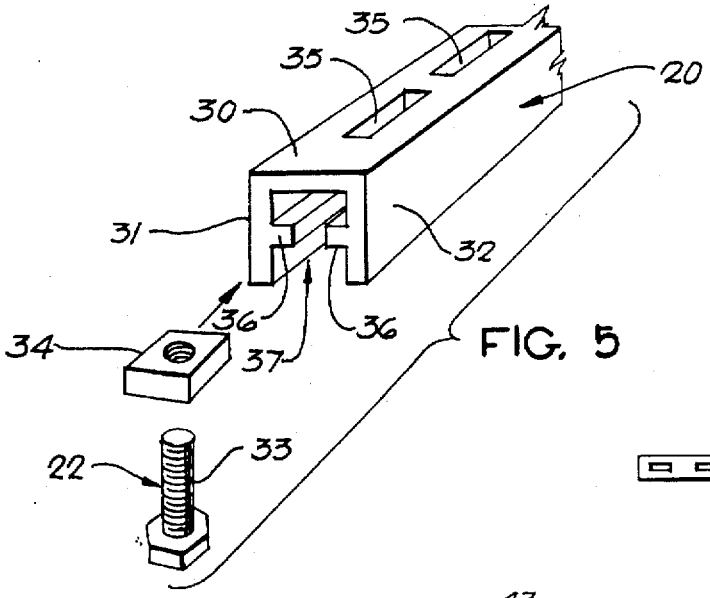
FIG. 5 is an enlarged, exploded perspective view of a foreshortened portion of a mounting rail and leveling bolt employed in the mounting system of this invention.
Figure 6:
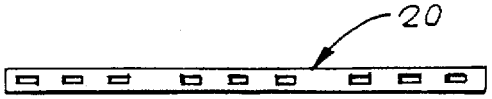
FIG. 6 is a top plan view of a mounting rail shown at the same scale as FIGS. 1 and 2.

As best shown in FIG. 5 of the drawings, the elongated mounting rails, indicated generally at 20, are formed as unitary extrusions of substantially inverted U-shaped cross section to include a planar top wall 30 and two depending parallel planar side walls 31 and 32 extending downwardly from the lateral limits of the top wall 30 and having a depth that is substantially equivalent to the width of top wall 30 although these dimensions may vary with load carrying requirements. In general, it is preferred that the extruded rails 20 be of lightweight aluminum, aluminum magnesium alloy or aluminum steel alloy capable of providing the desired rigidity and tensel strength required for an elongated beam in accordance with this invention.

Figure 4:
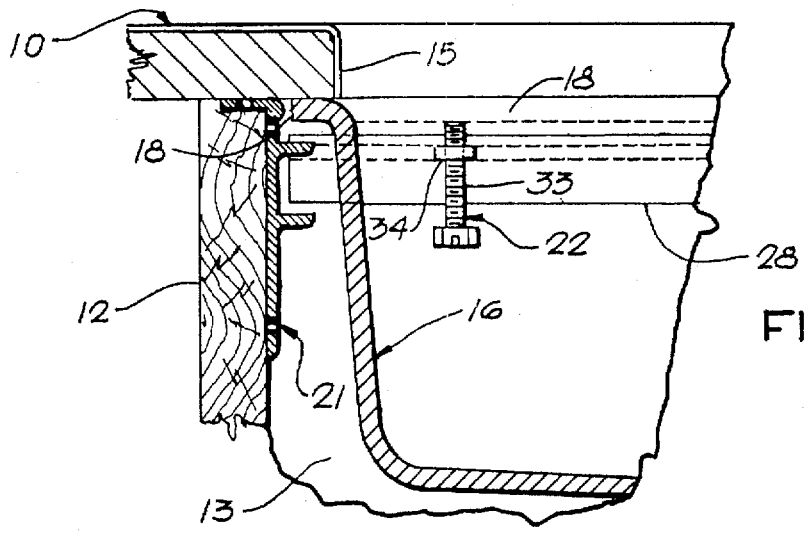
FIG. 4 is a partial, enlarged cross-sectional view showing one end of the full cross section illustrated in FIG. 2.

As previously noted rails 20 are designed to carry a plurality of selectively spaced leveling devices each of which in the illustrated case, constitutes a threaded bolt 33 with cooperative nut 34 (see FIG. 5). In order to accomplish the desired functional requirements of the rail the upper wall 30 thereof is periodically formed by punching or otherwise forming slots 35 at spaced intervals along its length which communicate with the interior of the inverted U-shaped configuration defined by the walls 30, 31 and 32 of the rail member. It further will be noted that each of the side walls 31 and 32 is formed with an inwardly projecting rib 36 which extend the length of walls 31 and 32 and partially across the interior of the inverted U rail configuration and which are separated by a medially disposed elongated slot 37. This slot has a width sufficient to permit the free passage of the body of the bolt members 33 for the purpose of slidably moving nut and bolt combinations along the ribs 36 between two desired overdisposed openings 35, 35 of the rail member. It also will be noted that two opposing ribs 36, 36 are spaced below the upper wall 30 of the extruded rail a distance sufficient to permit the introduction of the nuts 34 of the bolt and nut leveling devices between the upper side of the ribs 36 and the bottom side of top wall 30. Thus, the bolts 33 can be partially threaded into a nut 34 and that combination then slidably moved along the opening between the ribs 36 and wall 30 to a desired location opposite a slotted opening 35 in the manner shown in FIG. 4, for example. Thereafter threaded advancement of the bolt through the nut serves to advance the upper end of the threaded bolt shank into engagement with flange 18 of the sink structure whereby the latter may be leveled and clamped tightly against the underside of the countertop 10, as indicated in FIG. 4 of the drawings.

Figure 9:
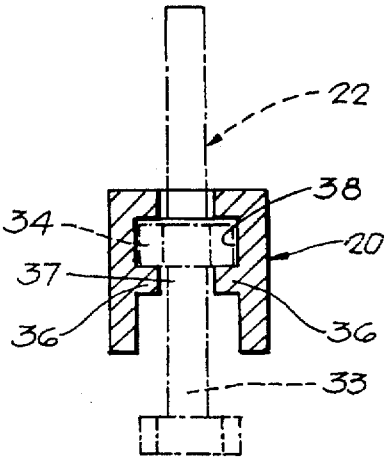
FIG. 9 is an enlarged, end elevational view of the mounting rail illustrated in FIG. 5, showing the leveling bolt and nut in dotted lines therein.

It also is to be noted that the two side walls 31, 32 are parallel and the bottom side of the rail 20 is open with no intervening wall in the zone between the bottom portions of walls 31 and 32 for reasons which will be clarified hereinafter (see FIG. 9).

While the two rails 20 serve to hold the adjustable leveling bolts and cooperating nuts for the purpose of clamping the rim of the sink tightly to the underside of the overlying countertop, as above described, it is essential for the successful operation of this operation that the rails be amply supported and held level in stationary spaced parallel relationship on opposite sides of the sink, so that the upward threading action of the bolts 33 serve to move the sink rim uniformly into engagement with the countertop. This function is accomplished by means of the mounting brackets 21 which are engaged with the opposite ends of each of the rails 20 to provide a reactionary platform against which the forces exerted by the leveling bolts are opposed.

Figure 7:
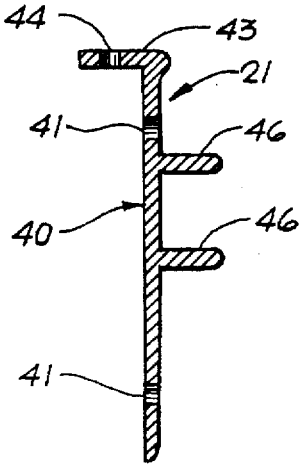
FIG. 7 is an enlarged side elevational view of a mounting bracket used to support the ends of a mounting rail shown in FIGS. 5 and 6.
Figure 8:
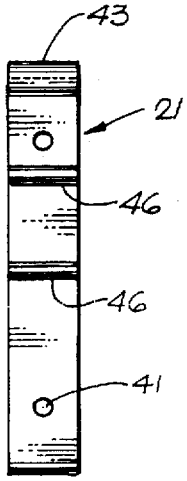
FIG. 8 is a front elevational view of the bracket shown in FIG. 7.

As shown in FIGS. 7 and 8, each of the brackets 21 comprises the elongated leg portion 40 having one or more openings 41 therethrough, one near the upper end and one near the lower end thereof for passage of appropriate screw fasteners. The uppermost end of the arm 40 is traversed by a right angularly related arm portion 43 of relatively short length having a screw receptive opening 44 therethrough. Extending in a opposite direction from the arm 43 and located at selected spaced intermediate positions along the length of the leg 40 are a plurality of projecting fingers 46, 46 (in this case two such fingers) which extend a short distance outwardly and at right angles to the plane of the leg 40. Like the rail 20, the brackets 21 preferably are extruded lightweight metal cut to a desired width for convenience and economy of production and to maintain uniformity of bracket dimensions.

As noted best in FIG. 4 of the drawings, the brackets 21 are mounted against the inside face of a cabinet wall, such as wall 12, or in lieu of such a wall a framing rail of the cabinet with the arm 43 thereof extending across the upper end of the wall 12 and preferably sunk in a rabbited socket so the upper face of the arm 43 lies flush with the upper edge of the wall 12 to avoid interference with full facial contact with the overlying countertop 10. If desired, a screw fastener may be passed through opening 44 of arm 43 to secure the upper end of the bracket 21 to the upper edge of the wall 12 with similar screw fasteners through the openings 41 of the leg 40 to secure the bracket in desired vertically extending fixed position, one at each end of the rail members 20. In most instances, the open bottom side of rails 20 may be placed directly over the selected one of the fingers 46 to rest on the internal ribs 36 in accordance with the depth of the sink's flange lip 18 and its thickness in formation. In some instances the sink lip flange is turned downwardly and in that instance, depending on the extent of the downturn the intermediate or even a lower finger may be employed. In practice it has been found that the presence of the two fingers 46 as shown are sufficient to meet most installation requirements.

In the FIG. 4 showing of a rail 20 and bracket 21, the brackets uppermost finger 46 is inserted into the nut receptive channel area between the upper faces of the ribs 36, 36 in the underface of upper wall 30 or the associated rail 20. In order to accomplish such an installation, the selected lip 46 is first inserted into such spacing of the rail, prior to fastening the bracket 21 to the cabinet wall or frame rail. This is accomplished by accurately measuring the spacing between the supports, such as opposing walls, of the cabinet or the supporting frame rails, and cutting the mounting rail 20 to appropriate length to accommodate the thickness of bracket legs 40. The selected fingers 46 of the bracket are then inserted into the nut receiving slot at both ends of the rail. The entire bracket and rail assembly is then deposited within the cabinet space and aligned with the sides of the sink. It will be understood that the extending finger 43 at the upper end of the bracket serves to suspend the bracket from the side wall of the cabinet or frame rail, as the case may be. Normally a screw fastener through the opening 44 thereof will be sufficient to maintain the bracket in a desired position once the weight of the sink is transferred to the rails 20 and leveling devices 22. In the alternative, as above mentioned, the brackets may be positioned and fastened in place and the rails 20 thereafter placed over one of the selected fingers of the bracket means to engage the underside of the two ribs 36, 36.

It is to be noted that the hereinabove described and illustrated assembly of this invention is particularly adapted for heavy cast metal or ceramic sinks and vanity basins to provide a novel mounting structure for such articles in fulfillment of that long felt need in the industry.

From the foregoing it is believed that those familiar with the art will readily understand and appreciate the novel advancement presented by this invention over the prior art and will appreciate that while the same has herein been described in association with a preferred embodiment thereof illustrated in the accompanying drawings, such embodiment is susceptible to variation, modification and substitution of equivalents without departing from the spirit and scope of the invention which is intended to be unlimited by the foregoing description except as may appear in the following appended claims.

The embodiments of the invention in which an exclusive property or privilege is claimed are defined as follows:

1. An assembly for mounting a sink or basin on the underside of a countertop mounted on suitable support structure; the sink or basin having a bowl bordered by a laterally extending rim flange, comprising:

a pair of like, rigid, elongated, unitary and linear mounting rails adapted to be positioned along opposite sides of the associated sink or basin bowl to engage the underside of the bowl's rim flange;

each rail having a planar upper wall formed with plural openings spaced along the length thereof;

a rigid mounting bracket adapted to be stationarily secured to said support structure for the associated countertop countertop, said bracket located adjacent opposite ends of each of said rails and comprising connective means interlocking with each rail for holding the same in co-planar, parallelism adjacently beneath said rim flange; and a plurality of axially adjustable, leveling devices supported on each rail to extend through selected of said openings in said upper wall, whereby to engage a the rim flange of the associated said bowl and to tightly clamp the same against the underside of said associated countertop.

2. The mounting assembly of claim 1, wherein said rails are formed as unitary extrusions of lightweight metal, cut to length recording to the dimensions of the sink and spacing between said mounting brackets, and said spaced openings are elongated slots for adjustable positioning of said leveling devices therein.

3. The mounting assembly of claim 1, wherein each of said leveling devices comprises a threaded bolt and nut and said mounting rails are formed with a pair of opposing interior ribs extending lengthwise thereof; said ribs being laterally separated by a slotted space receptive of the body of a bolt with a nut thereon being insertible between said ribs and the under face of said upper wall whereby the bolt and nut assemblies may be moved slidably along the length of said rails to selected positions opposite selected of said openings.

4. The mounting assembly of claim 1, wherein said mounting rails are formed as unitary metal extrusions having a substantially U-shaped cross section open along the bottom side and enclosed on the top side thereof; said upper wall being distinguished by plural spaced openings, and a pair of parallel, laterally spaced side walls extending from the lateral margins of said upper wall and having two parallel, co-planar, laterally spaced ribs extending along the inside opposing faces thereof and paralleling said upper wall to provide a chamber receptive of said leveling devices.

5. The mounting assembly of claim 1, wherein each of said mounting brackets comprises an elongated, linear leg having faster receptive openers for mounted the same to a suitable support, and a plurality of parallel fingers extending from one side of said leg and aligned at right angles thereto; said fingers operatively extending into the interior of a said mounting rail whereby to hold the same in a horizontal position.

* * * * *

UNITED STATES PATENT AND TRADEMARK OFFICE

CERTIFICATE OF CORRECTION

PATENT NO. : 5,743,501

DATED : April 28, 1998

INVENTOR(S) : William M. Rapp

It is certified that error appears in the above-identified patent and that said Letters Patent is hereby corrected as shown below:

Col. 6, line 6, delete second occurrence of "countertop";

Col. 6, line 19, delete "recording" and insert -- according --;

Col. 6, line 39, after "having" delete "two"

Col. 6, line 42, delete "and paralleling" and insert -- parallel to --;

Col. 6, line 42, after "wall" insert -- whereby --;

Col. 6, line 43, delete "a" and insert -- an interior --;

Col. 6, line 46, delete "mounted" and insert -- mounting --.

Signed and Sealed this

Twenty-sixth Day of January, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,743,501

DATED : 4/28/98

INVENTOR(S) : William M. Rapp

It is certified that error appears in the above-identified patent and that said Letters Patent is hereby corrected as shown below:

Col. 6, line 46, delete "faster" and insert -- fastener --; and

Signed and Sealed this

Ninth Day of March, 1999

*Attest:*

Q. TODD DICKINSON

*Attesting Officer*

*Acting Commissioner of Patents and Trademarks*